US007265769B2

(12) United States Patent
Amarakoon

(10) Patent No.: US 7,265,769 B2
(45) Date of Patent: Sep. 4, 2007

(54) DEVICE AND METHOD FOR REGISTERING MULTIPLE LED BAR IMAGERS IN AN IMAGE-ON-IMAGE SYSTEM

(75) Inventor: Kiri Amarakoon, Pittsford, NY (US)

(73) Assignee: Xerox Corporation, Stamford, CT (US)

( * ) Notice: Subject to any disclaimer, the term of this patent is extended or adjusted under 35 U.S.C. 154(b) by 350 days.

(21) Appl. No.: 11/088,177

(22) Filed: Mar. 24, 2005

(65) Prior Publication Data

US 2006/0215009 A1 Sep. 28, 2006

(51) Int. Cl.
*B41J 2/45* (2006.01)

(52) U.S. Cl. ..... 347/118; 347/130

(58) Field of Classification Search ..... 399/301; 347/116, 118, 130
See application file for complete search history.

(56) References Cited

U.S. PATENT DOCUMENTS 4,728,983 A 3/1988 Zwadlo et al.
4,731,622 A 3/1988 Hicks et al.
5,300,961 A * 4/1994 Corona et al. ..... 347/116
5,442,388 A * 8/1995 Schieck ..... 347/116
6,456,309 B1 9/2002 Panides et al.

* cited by examiner

*Primary Examiner*—Huan Tran
(74) *Attorney, Agent, or Firm*—Oliff & Berridge, PLC

(57) ABSTRACT

A method and apparatus adjusting the lateral position of an LED bar may minimize image banding in image-on-image systems having multiple LED bar imagers. A photoreceptor may be transported past a plurality of marking stations. At each marking station an LED bar imager extends in a direction perpendicular to the direction of transport of the medium. A mark may be sensed at each station and the lateral position of the LED bar, perpendicular to the direction of transport of the medium, may be adjusted according to the deviation of the position of the mark from a desired position.

18 Claims, 1 Drawing Sheet

DEVICE AND METHOD FOR REGISTERING MULTIPLE LED BAR IMAGERS IN AN IMAGE-ON-IMAGE SYSTEM

BACKGROUND

This invention relates to image plane registration systems, and more particularly to methods and apparatus for minimizing color fringing and image banding and registering multiple LED bar imagers to form a single image on a photoreceptor in an image-on-image system.

In electrophotographic systems, a photoreceptor may be supported by a mechanical carrier such as a drum or a belt. The photoreceptor may be charged to a generally uniform charge by subjecting the photoreceptor to a suitable charging device. The charge distribution on the photoreceptor may then be altered by the application of radiation, e.g., a laser, to the surface of the photoreceptor. Toner may then be attracted to the photoreceptor in a pattern consistent with the charge distribution on the photoreceptor.

Monochrome printers produce a hard copy in one toner color, typically black, and the copy may be made in a single pass of the charging device and toner source over the photoreceptor.

On the other hand, color printers use three primary colors, typically cyan, magenta and yellow, and in addition, optionally black. Several techniques have been developed over the years to adapt electrophotographic techniques to use multiple colors.

An exemplary apparatus for making high quality color prints by electrophotography is discussed in U.S. Pat. No. 4,728,983. A single photoconductive drum is electrostatically charged, laser-scan exposed, and toner developed during one rotation. In successive rotations different colored images corresponding to color separation images are assembled in register on the drum. This assembled color image is transferred to a receptor sheet in a final rotation of the drum.

U.S. Pat. No. 6,456,309 to Vittorio et al. discloses an apparatus for color image registration based upon belt and raster output scanner synchronization. A laser source projects a laser beam onto a multifaceted rotating polygon that sweeps the beam into a scan line across a moving photoreceptor. A start-of-scan detector produces start-of-scan signals when the laser beam is in position to write a scan line. A belt sensor produces belt signals when indicia on the photoreceptor pass a reference position. A controller receives the belt signals and the start-of-scan and then adjusts the photoreceptors rotational velocity such that the belt signals are an integral multiple of the start-of-scan signals.

U.S. Pat. No. 4,731,622 further discloses a multicolor electrostatic plotter in which toner applicators of different colors are successively applied to portions of a medium by repeatedly driving and rewinding a portion of the medium past an image head and the plurality of toner applicators for charge and toner application to imprint multiple color rasterized images on the medium by the use of electronic circuitry. A reference track on the medium is imprinted during the first color pass and deviations are detected during successive color passes. The plotter electronically adjusts the input data from a remote rasterizer by an amount equal to the substantially instantaneous offset so that lines of raster data are shifted by an amount substantially equal to the instantaneous displacement of the medium prior to charging the particular electrodes on the image head corresponding to the charge patterns for the next successive particular lines of raster information which are to be imprinted for the particular color image.

Each of the foregoing references is incorporated by reference in its entirety.

SUMMARY

In an image-on-image color printing system, the images imparted on a photoreceptor medium, such as a photoreceptive belt, must be registered accurately to minimize color fringing and image banding. When the first image is written, the belt, in moving to the second imaging station, may experience unwanted lateral movement, making correction of the belt position for the second image necessary.

In raster output scanner based systems, this correction may be accomplished by re-phasing the polygon. In an LED bar based imaging system, however, the imaging bar may be required to be physically moved to coincide with the previous imparted image.

Exemplary embodiments of devices and methods for registering at least one LED bar imager on a photoreceptor medium may incorporate an LED bar comprising an array of LEDs disposed along a length of the bar, a linear actuator and a reference mark sensor. The photoreceptor medium may be a continuous belt having a movement in a first direction, and one or more LED bar imagers may be mounted transverse to the first direction of the belt. The LED bar may be supported in such a manner that it may be slideably moved in a direction generally transverse to the direction of movement of the photoreceptor belt.

A sensor mounted on the LED bar may detect any lateral shift in the position of a reference mark, such as a line on the photoreceptor belt outside of the imaging area. A processing circuit may use the output of the sensor to generate an output voltage dependent upon the relative deviation of the reference line from a known point. The output signal of the processing circuit may control a linear actuator such as a voice coil or a piezoelectric actuator, whereby the lateral position of the LED bar may be adjusted, for example, to within an accuracy of a sub half-pixel, to coincide with a previously imparted image.

Thus, exemplary embodiments may enable precise registration of image-on-image color imaging for one-pass systems having multiple LED bar imagers.

BRIEF DESCRIPTION OF THE DRAWINGS

Various exemplary embodiments are described in detail, with reference to the following figures, wherein.

DETAILED DESCRIPTION OF EMBODIMENTS

The following detailed description of exemplary embodiments is particularly directed to an approach to LED bar registration for image-on-image color printers. Thus, the following detailed description makes specific reference to Xerographic devices, such as the color printer illustrated in FIG. 1. However, it should be understood that the principles and techniques described herein may be used in other devices and methods, for example, utilizing direct writing techniques such as ink jet arrays, thermal arrays as used for thermal transfer color printing, solid ink imaging systems, and the like.

Figure 1:
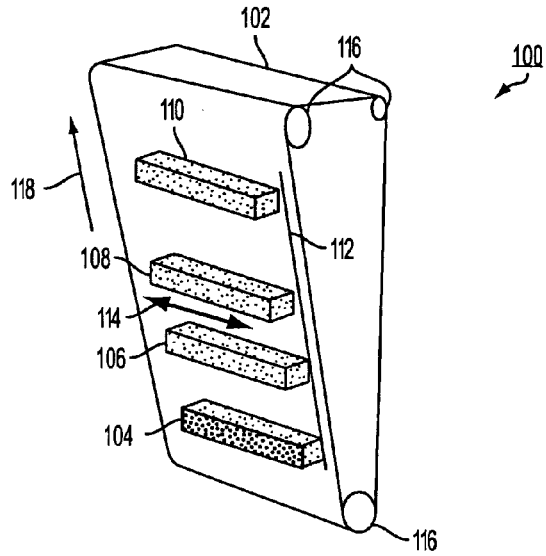
FIG. 1 illustrates an image-on-image system incorporating an apparatus and method for registering multiple LED bar imagers on a photoreceptor medium.
Figure 2:
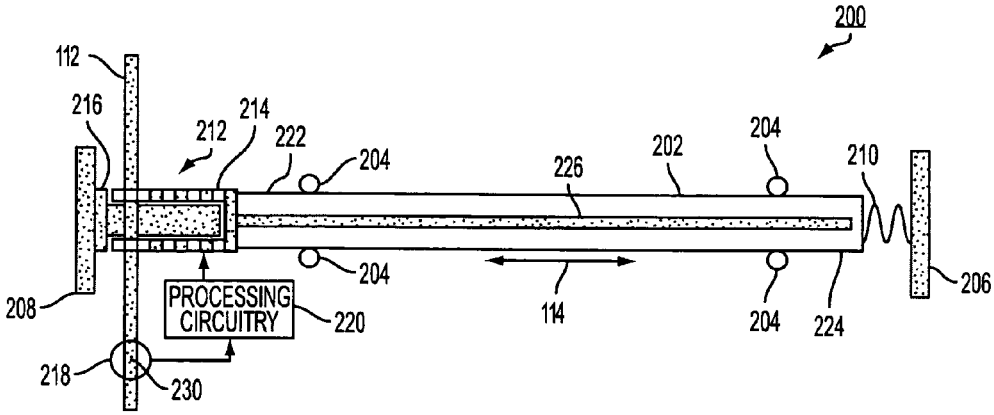
FIG. 2 is an exemplary LED bar assembly according to the image-on-image system of FIG. 1.

FIG. 1 illustrates an exemplary embodiment of an image-on-image device 100 comprising a photoreceptor medium 102 and at least one marking station 104-110, wherein each marking station further comprises an LED bar assembly 200, as shown in FIG. 2. Multiple marking stations 104-110 may be provided, for example, to impart an image in each of three complementary colors, typically cyan, magenta and yellow, and optionally black.

The photoreceptor medium 102 may be a continuous belt mounted on a transport system 116 configured to move the photoreceptor belt 102 in a first direction 118 past a series of sequentially spaced marking stations 104-110, marking station 104 being first in line.

Each marking station 104-110 may comprise the LED bar assembly 200 illustrated in FIG. 2. However, as discussed further below, not all of the making stations 104-110 need comprise the LED bar assembly 200. Each LED bar assembly 200 may further comprise an LED bar 202 having a first end 222, a second end 224 and an array of LEDs 226 disposed along a length of the LED bar 202. The LED bar 202 may be supported by flexures 204, and may be slideably mounted so to be moveable in a direction 114 substantially transverse to a direction 118 of the photoreceptor belt 102 by operation of a sensor 218, processing circuitry 220, and a linear actuator 212.

In exemplary embodiments, the sensor 218 may be an optical sensor, or an array of optical sensors, having a detection footprint greater than a width of a reference mark or line 112 on the photoreceptor belt 102. The sensor 218 may be mounted on the LED bar 202 upstream of the array of LEDs 226, thereby providing sufficient time for the sensor 218, the respective electronic circuit 220 and the actuator 212, to adjust the lateral position of the LED bar 202 to be coincident with an image imparted by an upstream LED bar, before the detected point 230 passes a point in line with the LED array 226. The lateral position of the sensor reference point, typically the center of the sensor, may have a fixed and known relationship to each LED of the array 226, and may be predetermined, for example, at the time of manufacture. Detection of a reference line and determination of deviation from a known reference point may be accomplished by various techniques known to those of ordinary skill in the field of imaging devices.

The electronic circuit 220, associated with each LED assembly 200, may be in communication with the output of the respective sensor 218. The location of each circuit 220 is non-limiting and each may be collocated with the sensor 218 on the LED bar 202, or may be collocated with other electronic circuits 220 and be mounted in any convenient location within the device 100. An output of the circuit 220 may provide the actuator 212 with a voltage proportional to the relative transverse deviation of the reference line 112 from a known point, thereby causing the actuator 212 to move the LED bar 202 until the sensor indicates that there is no alignment error so as to maintain a substantially precise image registration with upstream LED bar imagers. The LED bar thus may continuously track the reference line.

In exemplary embodiments, an actuator 212, disposed on a first end 222 of the LED bar 202, may be configured to move the LED bar 202 in a substantially axial direction 114 responsive to the output of electronic circuitry 220. The linear actuator 212 may comprise a voice coil, a piezoelectric actuator or any other suitable actuator 212, preferably accurate to within, or better than, at least a sub one-half pixel. The linear actuator 212 may have a fixed portion 214 and a non-fixed portion 216, the fixed portion 214 being axially mounted to the first end 222 of the LED bar 202, and the non-fixed portion 216 mounted in an axially aligned, abutting relation with a frame support member 208. Biased by a spring 210, the second end 224 of LED bar 202 may be supported by a frame support member 206.

In exemplary embodiments, the reference line 112 may be permanently disposed toward one side of the photoreceptor belt 102 outside the image area. In such embodiments, each LED bar assembly 200 may be moveable in a direction 114 substantially perpendicular to the direction 118 of the photoreceptor belt 102 in order to correct for any transverse movement of the photoreceptor belt 102.

An exemplary embodiments, the marking station 104 first in the line of successive marking stations 104-110 may form the reference line 112 on the belt. In such embodiments, the marking station 104 may comprise a non-moveable LED bar. Because the marking station 104 renders a registration mark, reference line 112, the marking station 104 is automatically aligned therewith.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art and are also intended to be encompassed by the following claims.

What is claimed is:

1. An LED bar image registering device, comprising:

an LED bar including an array of LEDs disposed thereon, the LED bar configured to mount generally perpendicular to a direction of movement of a photoreceptor medium of an image-on-image apparatus, the LED bar being arranged to move in a direction substantially transverse to the direction of movement of the photoreceptor medium; and a sensor mounted upstream of the array of a respective LED of the LED bar, the sensor providing an output and configured to detect a position of a reference mark disposed on the medium as the medium passes the sensor;

wherein the movement of the LED bar is determined by a deviation of the detected position of the reference mark from a predetermined position.

2. The device of claim 1, wherein the LED bar further comprises a linear actuator axially disposed at one end of the LED bar, the linear actuator configured to move the LED bar in the substantially transverse direction in response to an input signal proportional to a deviation of the detected position of the reference mark from a predetermined position.

3. The device of claim 2, wherein the linear actuator produces a movement accurate to within at least a sub half-pixel.

4. The device of claim 2, further comprising a processing circuit in communication with the output of the sensor, the processing circuit configured to generate the input signal to the linear actuator.

5. The device of claim 2, wherein any required movement of the LED bar may be determined before the detected position of the reference mark passes by the array of LEDs.

6. The device of claim 1, wherein the sensor comprises at least one optical sensor.

7. A Xerographic device comprising the LED bar image registering device of claim 1.

8. A Xerographic apparatus, comprising:

a photoreceptor medium moveably mounted in the apparatus, the photoreceptor medium having a reference mark, the photoreceptor medium moveable in a first direction; and at least one LED bar having a movement in a second direction transverse to the first direction, wherein the LED bar includes:

an array of LEDs disposed thereon; and a sensor mounted upstream of the array of LEDs, the sensor providing an output and configured to detect a position of a reference mark as the medium passes the sensor, wherein the movement of the LED bar in the second direction is determined by a deviation of the detected position of the reference mark from a predetermined position.

9. The apparatus of claim 8, wherein the reference mark comprises a permanent line on the medium in the first direction.

10. The apparatus of claim 8, further comprising a succession of spaced LED bars in the first direction.

11. The apparatus of claim 10, wherein a first LED bar in the succession is fixedly mounted in the second direction.

12. The apparatus of claim 8, wherein the LED bar further comprises a linear actuator axially disposed at one end of the LED bar, the linear actuator configured to move the LED bar in the second direction in response to an input signal proportional to the deviation of the detected position of the reference mark from the predetermined position.

13. The apparatus of claim 12, wherein the linear actuator produces a movement accurate within a sub half-pixel.

14. A method of registering an LED bar in a Xerographic device, comprising:

moving a photoreceptor medium along a first direction of movement past at least one LED bar having an array of LEDs, the photoreceptor medium having a reference line imparted thereon in the first direction;

detecting a deviation of the reference line from a predetermined point along the LED bar;

moving the LED bar in the second direction in accordance with the detected deviation; and detecting the deviation upstream of the array of LEDs on the respective LED bar detecting the deviation.

15. The method of claim 14, further comprising imparting multiple images onto the photoreceptor medium in a single pass using a succession of LED bars.

16. The method of claim 15, further comprising imaging the reference mark on the photoreceptive medium, wherein the first LED bar is fixed relative to the second direction of movement.

17. The method of claim 14, comprising moving the LED bar, by an amount proportional to the deviation, to within an accuracy of a sub half-pixel.

18. The method of claim 14, wherein moving the LED bar further comprises controlling a linear actuator axially mounted on one end of the LED bar.

* * * * *